US010103434B2

(12) United States Patent
Maltsev et al.

(10) Patent No.: US 10,103,434 B2
(45) Date of Patent: Oct. 16, 2018

(54) MILLIMETER-WAVE HIGH-GAIN STEERABLE REFLECT ARRAY-FEEDING ARRAY ANTENNA IN A WIRELESS LOCAL AREA NETWORKS

(71) Applicant: Intel Corporation, Santa Clara, CA (US)

(72) Inventors: Alexander Maltsev, Nizhny Novgorod (RU); Ali S. Sadri, San Diego, CA (US); Andrey Pudeyev, Nizhny Novgorod (RU)

(73) Assignee: Intel Corporation, Santa Clara, CA (US)

( * ) Notice: Subject to any disclaimer, the term of this patent is extended or adjusted under 35 U.S.C. 154(b) by 51 days.

(21) Appl. No.: 15/088,249

(22) Filed: Apr. 1, 2016

(65) Prior Publication Data

US 2017/0077600 A1 Mar. 16, 2017

Related U.S. Application Data

(60) Provisional application No. 62/218,606, filed on Sep. 15, 2015.

(51) Int. Cl.

| | |
|---|---|
| ***H01Q 3/00*** | (2006.01) |
| ***H01Q 3/46*** | (2006.01) |
| ***H01Q 21/29*** | (2006.01) |
| ***H01Q 3/34*** | (2006.01) |

(52) U.S. Cl.

CPC ..... *H01Q 3/46* (2013.01); *H01Q 3/34* (2013.01); *H01Q 21/29* (2013.01)

(58) Field of Classification Search

CPC ..... H01Q 3/34; H01Q 3/46
USPC ..... 342/81, 154, 368, 371, 372, 373; 343/755, 837

See application file for complete search history.

(56) References Cited

U.S. PATENT DOCUMENTS

| | | | |
|---|---|---|---|
| 8,193,994 | B2 | 6/2012 | Alamouti et al. |
| 2003/0179142 | A1 | 9/2003 | Nakamura et al. |
| 2006/0214833 | A1 | 9/2006 | Baharav et al. |
| 2009/0219903 | A1 | 9/2009 | Alamouti et al. |

(Continued)

FOREIGN PATENT DOCUMENTS

| | | | |
|---|---|---|---|
| WO | WO-2014091274 | A1 | 6/2014 |
| WO | WO-2017048429 | A1 | 3/2017 |

OTHER PUBLICATIONS

"International Application Serial No. PCT/US2016/047033, International Search Report dated Nov. 21, 2016", 3 pgs.

(Continued)

*Primary Examiner* — Dao L Phan

(74) *Attorney, Agent, or Firm* — Schwegman Lundberg & Woessner, P.A.

(57) ABSTRACT

A reflect array-feeding array (RA-FA) antenna is disclosed. The RA-FA antenna comprising: a reflect array base comprising a plurality of reflecting elements with a phase shift distribution to reflect an incident beam to generate a reflected beam having a narrower beamwidth in an elevation plane and a same beamwidth in an azimuth plane, and a feeding array comprising a phased antenna array with a beam-steering ability to direct the incident beam at the reflecting elements. The reflecting elements may be configured in a pattern with rows and columns and reflecting elements along rows have a same phase shift, and reflecting elements along columns have phase shifts to narrow the incident beam to form the reflected beam narrower in the elevation plane.

18 Claims, 11 Drawing Sheets

(56) References Cited

U.S. PATENT DOCUMENTS

| | | | |
|---|---|---|---|
| 2010/0033390 | A1 | 2/2010 | Siavash et al. |
| 2014/0368385 | A1 | 12/2014 | Haluba et al. |

OTHER PUBLICATIONS

"International Application Serial No. PCT/US2016/047033, Written Opinion dated Nov. 2116", 7 pgs.

Venneri, F, et al., "Tunable Reflectarray Cell for Wide Angle Beam-Steering Radar Applications", Hindawi Publishing Corporation Journal of Electrical and Computer Engineering vol. 2013, Article ID 325746 (2013), 7 pgs.

"International Application Serial No. PCT US2016 047033, International Preliminary Report on Patentability dated Mar. 29, 2018", 9 pgs.

MILLIMETER-WAVE HIGH-GAIN STEERABLE REFLECT ARRAY-FEEDING ARRAY ANTENNA IN A WIRELESS LOCAL AREA NETWORKS

PRIORITY CLAIM

This application claims the benefit of priority under 35 U.S.C. 119(e) to U.S. Provisional Patent Application Ser. No. 62/218,606, filed Sep. 15, 2015, which is incorporated herein by reference in its entirety.

TECHNICAL FIELD

Embodiments pertain to wireless communications in a wireless local-area network (WLAN). Some embodiments relate to steerable millimeter-wave reflect array antennas. Some embodiments relate to Institute of Electrical and Electronic Engineers (IEEE) 802.11 and some embodiments relate to IEEE 802.11ay. Some embodiments relate to IEEE 802.11ad. Some embodiments relate to next generation 60 gigahertz (NG60) and/or WiGig. Some embodiments relate to methods, apparatus, and computer readable media for millimeter-wave high-gain steerable reflect array feeding array antennas in a WLAN.

BACKGROUND

Users of wireless networks often demand more bandwidth and faster response times. However, the available bandwidth may be limited. It may improve the efficiency of the wireless network to perform beamforming to communicate with wireless device. However, it may be difficult to transmit a beam with a particular azimuth and elevation. Moreover, wireless devices may operate with different communication standards.

BRIEF DESCRIPTION OF THE DRAWINGS

The present disclosure is illustrated by way of example and not limitation in the figures of the accompanying drawings, in which like references indicate similar elements and in which.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
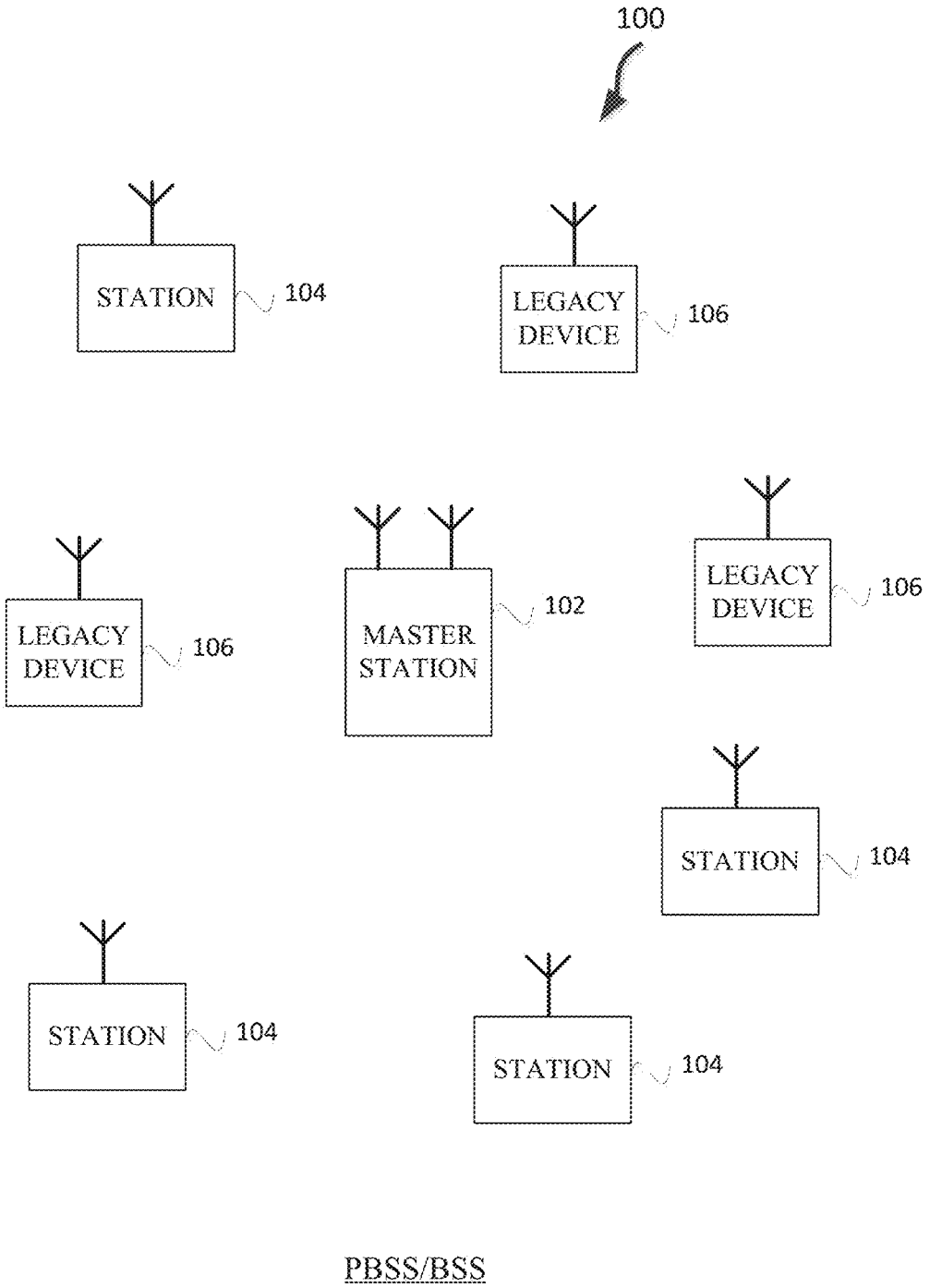
FIG. 1 illustrates a WLAN in accordance with some embodiments.

FIG. 1 illustrates a WLAN 100 in accordance with some embodiments. The WLAN may comprise a basis service set (BSS) 100 that may include a master station 102, which may be an AP, a plurality of wireless (e.g., IEEE 802.11ay) STAs 104 and a plurality of legacy (e.g., IEEE 802.11n/ac/ad) devices 106.

The master station 102 may be an AP using the IEEE 802.11 to transmit and receive. The master station 102 may be a base station. The master station 102 may use other communications protocols as well as the IEEE 802.11 protocol. The IEEE 802.11 protocol may be IEEE 802.11ay. The IEEE 802.11 protocol may include using orthogonal frequency division multiple-access (OFDMA), time division multiple access (TDMA), and/or code division multiple access (CDMA). The IEEE 802.11 protocol may include a multiple access technique. For example, the IEEE 802.11 protocol may include space-division multiple access (SDMA) and/or multiple-user multiple-input multiple-output (MU-MIMO). The master station 102 and/or wireless STA 104 may be configured to operate in accordance with NG60, IEEE 802.1ad, and/or WiGig.

The legacy devices 106 may operate in accordance with one or more of IEEE 802.11 a/b/g/n/ac/ad/af/ah/aj, or another legacy wireless communication standard. The legacy devices 106 may be STAs or IEEE STAs. The wireless STAs 104 may be wireless transmit and receive devices such as cellular telephone, smart telephone, handheld wireless device, wireless glasses, wireless watch, wireless personal device, tablet, or another device that may be transmitting and receiving using the IEEE 802.11 protocol such as IEEE 802.11ay or another wireless protocol. In some embodiments, the wireless STAs 104 may operate in accordance with IEEE 802.11ax.

The master station 102 may communicate with legacy devices 106 in accordance with legacy IEEE 802.11 communication techniques. In example embodiments, the master station 102 may also be configured to communicate with wireless STAs 104 in accordance with legacy IEEE 802.11 communication techniques. The master station 102 may be a personal basic service set (PBSS) Control Point (PCP) which can be equipped with large aperture antenna array or Modular Antenna Array (MAA).

In some embodiments, a IEEE 802.11ay frame may be configurable to have the same bandwidth as a subchannel. The bandwidth of a subchannel may be 20 MHz, 40 MHz, or 80 MHz, 160 MHz, 320 MHz contiguous bandwidths or an 80+80 MHz (160 MHz) non-contiguous bandwidth. In some embodiments, the bandwidth of a subchannel may be 1 MHz, 1.25 MHz, 2.03 MHz, 2.5 MHz, 5 MHz and 10 MHz, or a combination thereof or another bandwidth that is less or equal to the available bandwidth may also be used. In some embodiments the bandwidth of the subchannels may be based on a number of active subcarriers. In some embodiments the bandwidth of the subchannels are multiples of 26 (e.g., 26, 52, 104, etc.) active subcarriers or tones that are spaced by 20 MHz. In some embodiments the bandwidth of the subchannels is 256 tones spaced by 20 MHz. In some embodiments the subchannels are multiple of 26 tones or a multiple of 20 MHz. In some embodiments a 20 MHz subchannel may comprise 256 tones for a 256 point Fast Fourier Transform (FFT).

An 802.11ay frame may be configured for transmitting a number of spatial streams, which may be in accordance with MU-MIMO. In other embodiments, the master station 102, wireless STA 104, and/or legacy device 106 may also implement different technologies such as code division multiple access (CDMA) 2000, CDMA 2000 1×, CDMA 2000 Evolution-Data Optimized (EV-DO), Interim Standard 2000 (IS-2000), Interim Standard 95 (IS-95), Interim Standard 856 (IS-856), Long Term Evolution (LTE), Global System for Mobile communications (GSM), Enhanced Data rates for GSM Evolution (EDGE), GSM EDGE (GERAN), IEEE 802.16 (i.e., Worldwide Interoperability for Microwave Access (WiMAX)), BlueTooth®, or other technologies.

Some embodiments relate to 802.11ay communications. In accordance with some IEEE 802.11ay embodiments, a master station 102 may operate as a master station which may be arranged to contend for a wireless medium (e.g., during a contention period) to receive exclusive control of the medium for performing enhanced beamforming training for a multiple access technique such as OFDMA or MU-MIMO. In some embodiments, the multiple-access technique used during the HEW control period may be a scheduled OFDMA technique, although this is not a requirement. In some embodiments, the multiple access technique may be a time-division multiple access (TDMA) technique or a frequency division multiple access (FDMA) technique. In some embodiments, the multiple access technique may be a space-division multiple access (SDMA) technique.

The master station 102 may also communicate with legacy stations 106 and/or wireless stations 104 in accordance with legacy IEEE 802.11 communication techniques.

In example embodiments, the HEW device 104 and/or the master station 102 are configured to perform the methods and functions herein described in conjunction with FIGS. 1-10.

Figure 2:
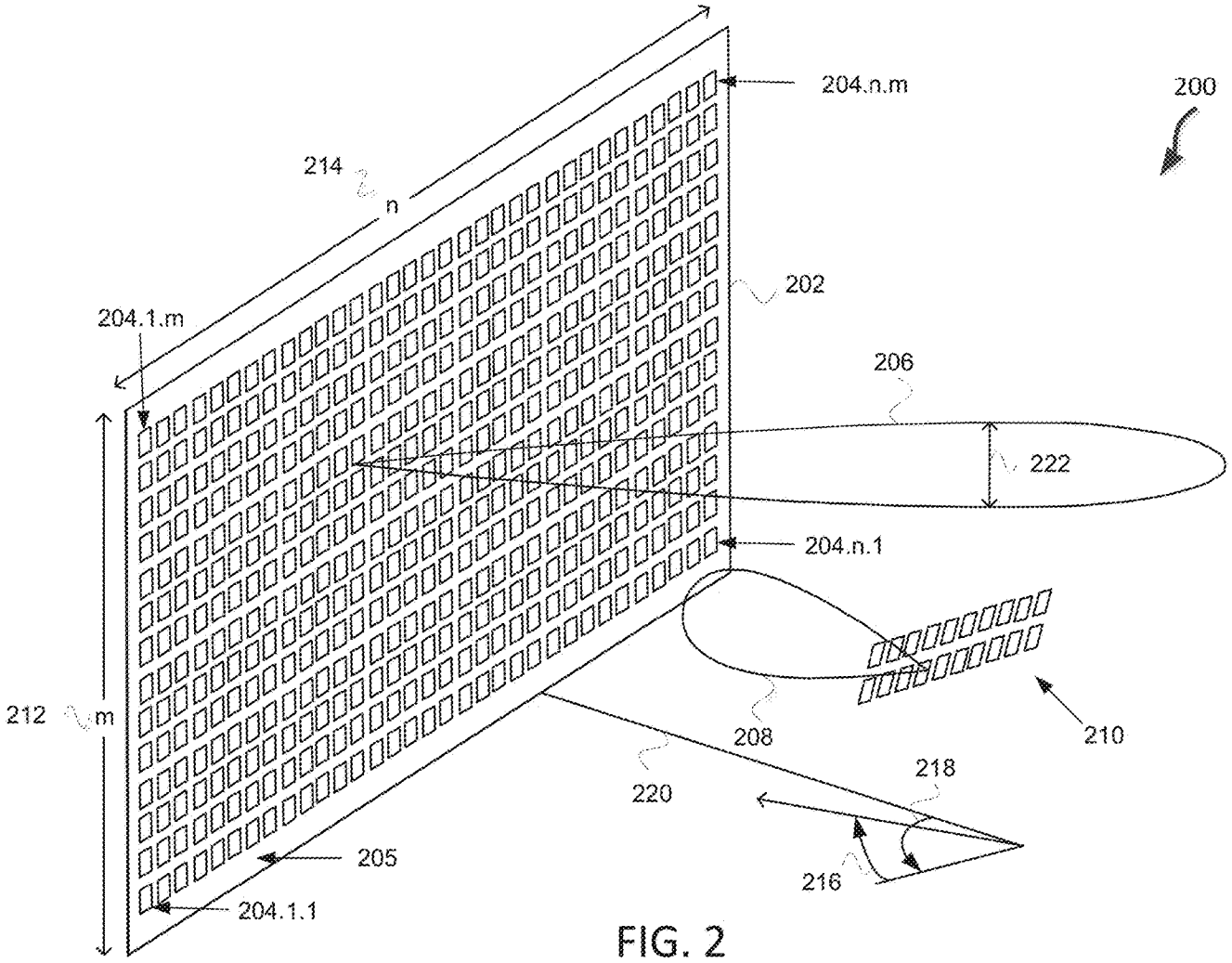
FIG. 2 illustrates a millimeter-wave steerable reflect array-feeding array antenna in a WLAN in accordance with some embodiments.

FIG. 2 illustrates a millimeter-wave steerable reflect array-feeding array antenna 200 in a WLAN in accordance with some embodiments. Illustrated in FIG. 2 is reflect array 202, phased antenna array 210, altitude 216, azimuth 218, normal line 220, phased antenna array beam 208, and reflected phased antenna array beam 206.

The reflect array 202 includes reflective elements 204 and substrate 205. There may be n 214 by in 212 reflecting elements 204. The corners of the reflect array 202 may be 204.1.1, **204.*n*.1, 204.1.*m*, and 204.*n.m*. The reflective elements 204 may be arranged in a pattern such as a rectangular pattern (as illustrated), a square pattern, or another suitable pattern. In some embodiments, the reflective elements 204 may have a crossed dipole structure that reflects both s-polarized and p-polarized EM waves simultaneously. The reflective elements 204 phase distribution allows focusing the phased antenna array beam 208 in the altitude 216 plane with a simple reflection in the azimuth 218 plane. The azimuth beamwidth 222 of the phased antenna array beam 208 may remain substantially unchanged by the reflection from the reflect array 202**.

The reflect array 202 may be an array of reflecting elements 204 printed on a substrate 205, The reflecting elements 204 configured to provide pre-adjusted phasing to form a focused beam (e.g., reflected phased antenna array beam 206). The reflect array 202 permits beam steering by the phased antenna array 210 so that the pre-adjusted phasing is the same or similar for phased antenna array beams 208 that strike the reflect array 202 at different angles.

In some embodiments, the reflect array 202 permits beam steering by the phased antenna array 210 so that the pre-adjusted phasing is the same or similar for phased antenna array beams 208 that strike the reflect array 202 at angles that may vary from 120-150 degrees. In some embodiments, the millimeter-wave steerable reflect array-feeding array antenna 200 may have again and directivity of 20-35 dBi.

The phased antenna array 210 may be configured for beamsteering (see FIG. 4) The phased antenna array 210 may be configured for beamforming, beamsteering, and/or beamsplitting.

In operation, the phased antenna array 210 emits phased antenna array beam 208 which reflects off the reflect array 202 in accordance with a pre-adjusted phasing to form reflected phased antenna array beam 206.

Figure 3:
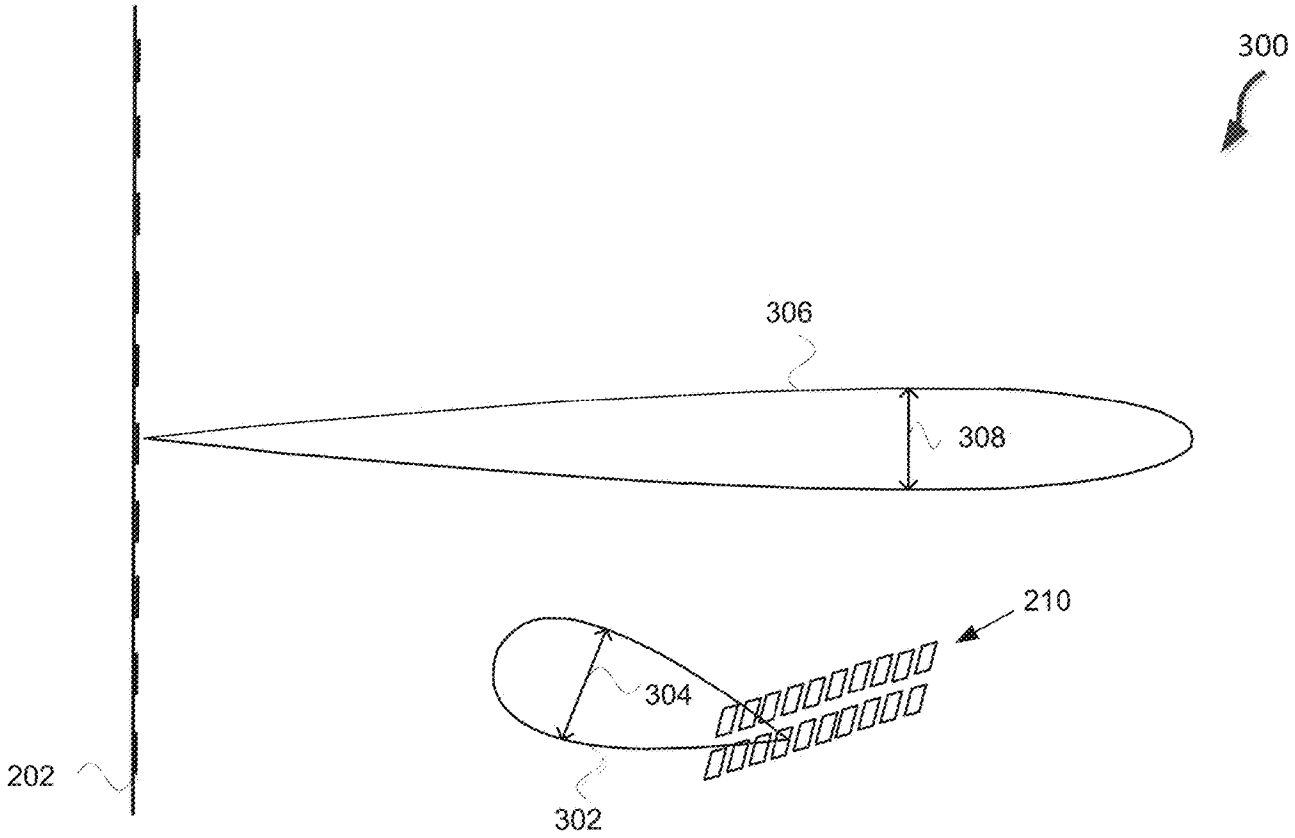
FIG. 3 illustrates an elevation plane view of the millimeter-wave steerable reflect array-feeding array antenna in a WLAN in accordance with some embodiments.

FIG. 3 illustrates an elevation plane view of the millimeter-wave steerable reflect array-feeding array antenna 300 in a WLAN in accordance with some embodiments. Illustrated in FIG. 3 is reflect array 202, phased antenna array 210, phased antenna array beam 302, and reflected phased antenna array beam 306. The phased antenna array beam 302 has width 304. The reflected phased antenna array beam 306 has width 308. The phased antenna array beam 302 may be focused by the reflect array 202 in the elevation plane and forming the reflected phased antenna array beam 306 which may be a narrower beam with a several times beamwidth decrease. The azimuth beamwidth (see FIG. 4) of the phased antenna array beam 302 may remain the same or approximately the same in the reflected phased antenna array beam 306.

Figure 4:
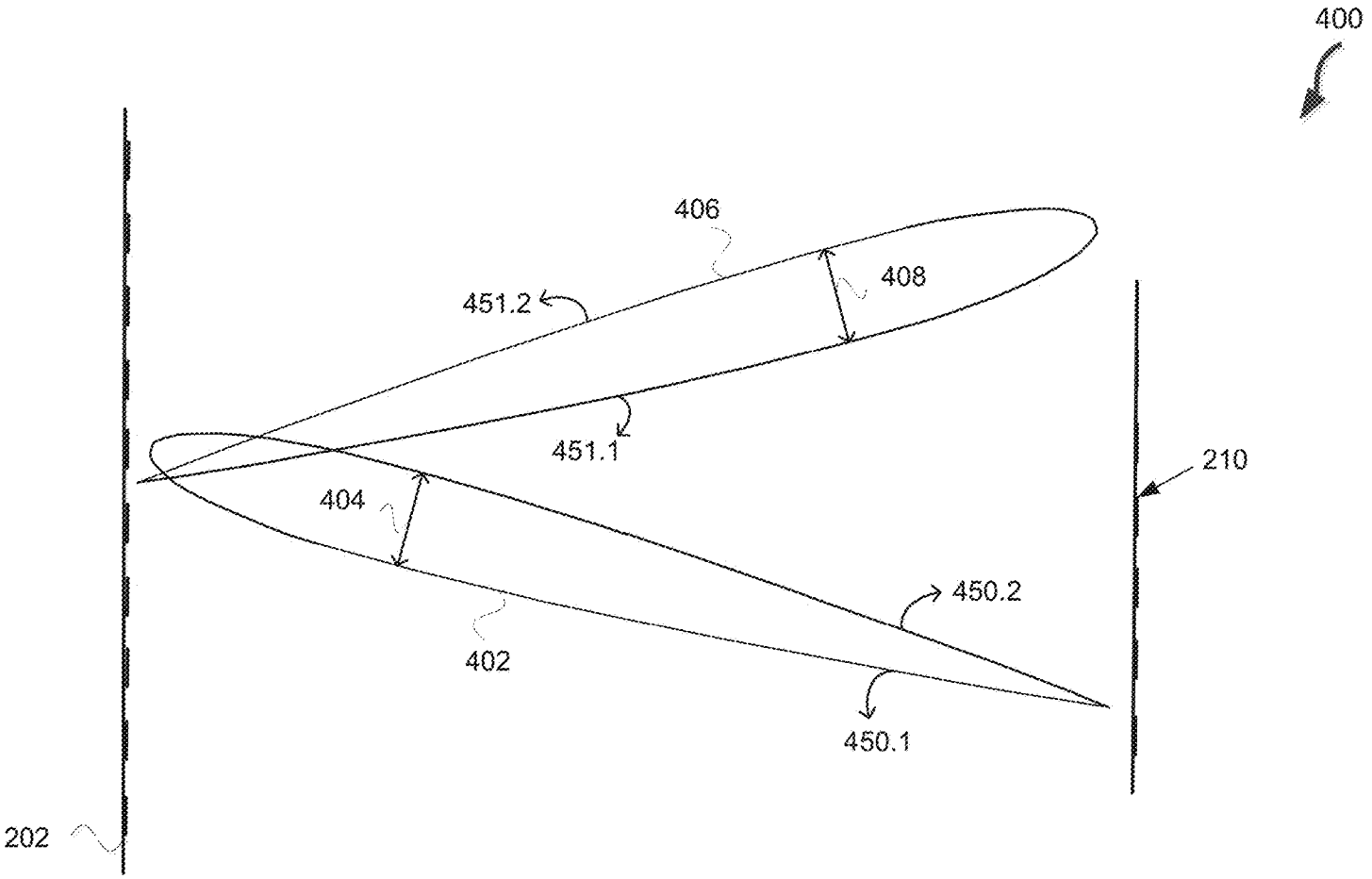
FIG. 4 illustrates an azimuth plane view of the millimeter-wave steerable reflect array-feeding array antenna in a WLAN in accordance with some embodiments.

FIG. 4 illustrates an azimuth plane view of the millimeter-wave steerable reflect array-feeding array antenna 400 in a WLAN in accordance with some embodiments. Illustrated in FIG. 4 is reflect array 202, phased antenna array 210, phased antenna array beam 402, and reflected phased antenna array beam 406. The phased antenna array beam 402 has width 404. The reflected phased antenna array beam 406 has width 408, The phased antenna array beam 402 may have the same or approximately the same width 404 as the width 408 of the reflected phased antenna array beam 406 which is reflected off the reflect array 202. The elevation plane beamwidth (see FIG. 4) of the phased antenna array beam 402 may be narrowed in the reflected phased antenna array beam 406.

The phased antenna array 210 may be configured for beam steering. For example, the phased antenna array beam 402 may be steered in a direction of 450.2 or 450.1. The reflected phased antenna array beam 406 with then reflect off the reflect array 202 with a different angle. For example, the reflected phased antenna beam 406 may move in a direction of 451.1 (in response to direction of 450.1). The phased antenna array beam 402 may be generated with different azimuth angles from the phased antenna array 210. The phased antenna array 210 may be configured for beamforming, beamsteering, and/or beamsplitting.

Figure 5:
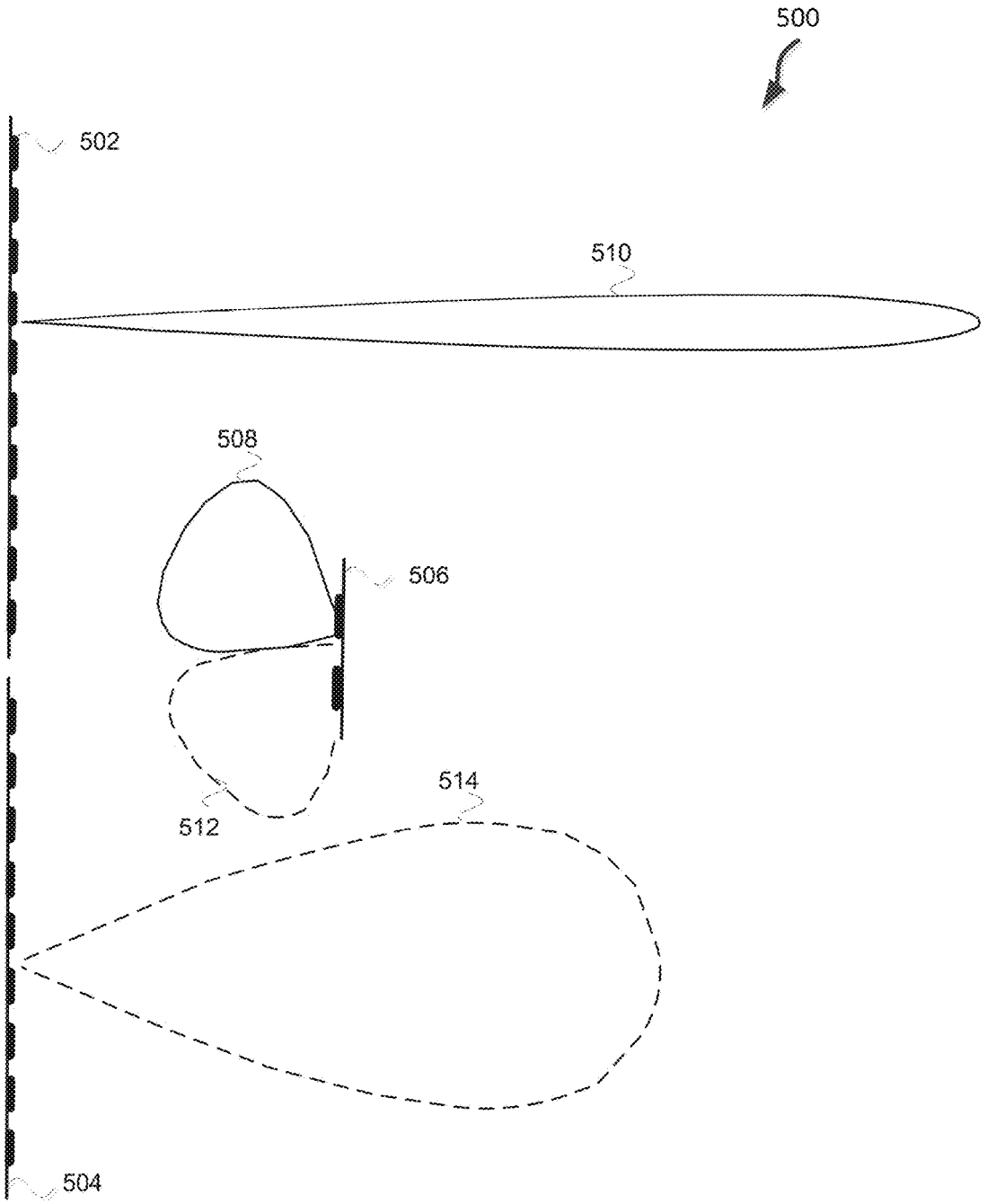
FIG. 5 illustrates a millimeter-wave steerable reflect array-feeding array antenna with two reflect arrays in accordance with some embodiments.

FIG. 5 illustrates a millimeter-wave steerable reflect array-feeding array antenna 500 with two reflect array s in accordance with some embodiments. Illustrated in FIG. 5 is a first reflect array 502, a second reflect array 504, phased antenna array 506, first phased antenna array beam 508, second phased antenna array beam 512, first reflected phased antenna array beam 510, and second reflected phased antenna array beam 514. FIG. 5 is an elevation plane view. The first reflect array 502 and the second reflect array 504 have different phase distributions. The phased antenna array 506 feeds both the first reflect array 502 and the second reflect array 504. The first reflect array 502 is configured to reflect extra narrower beams with higher gain. For example, first phased antenna array beam 508 reflects off of the first reflect array 502 as first reflected phased antenna array beam 510 and is narrower with a higher gain. The second reflect array 512 is configured to reflect the beam with the same or similar beam widths from elevation plane. For example, second phased antenna array beam 512 reflects off of the second reflect array 504 as second reflected phased antenna array beam 514 and has the same or similar beamwidth. The phased antenna array 506 may then switch between the first reflect array 502 and the second reflect array 504 to manipulate the first reflected phased antenna array beam 510 or second reflected phased antenna array beam 514 depending on the communication needs of the millimeter-wave steerable reflect array-feeding array antenna 500.

Figure 6:
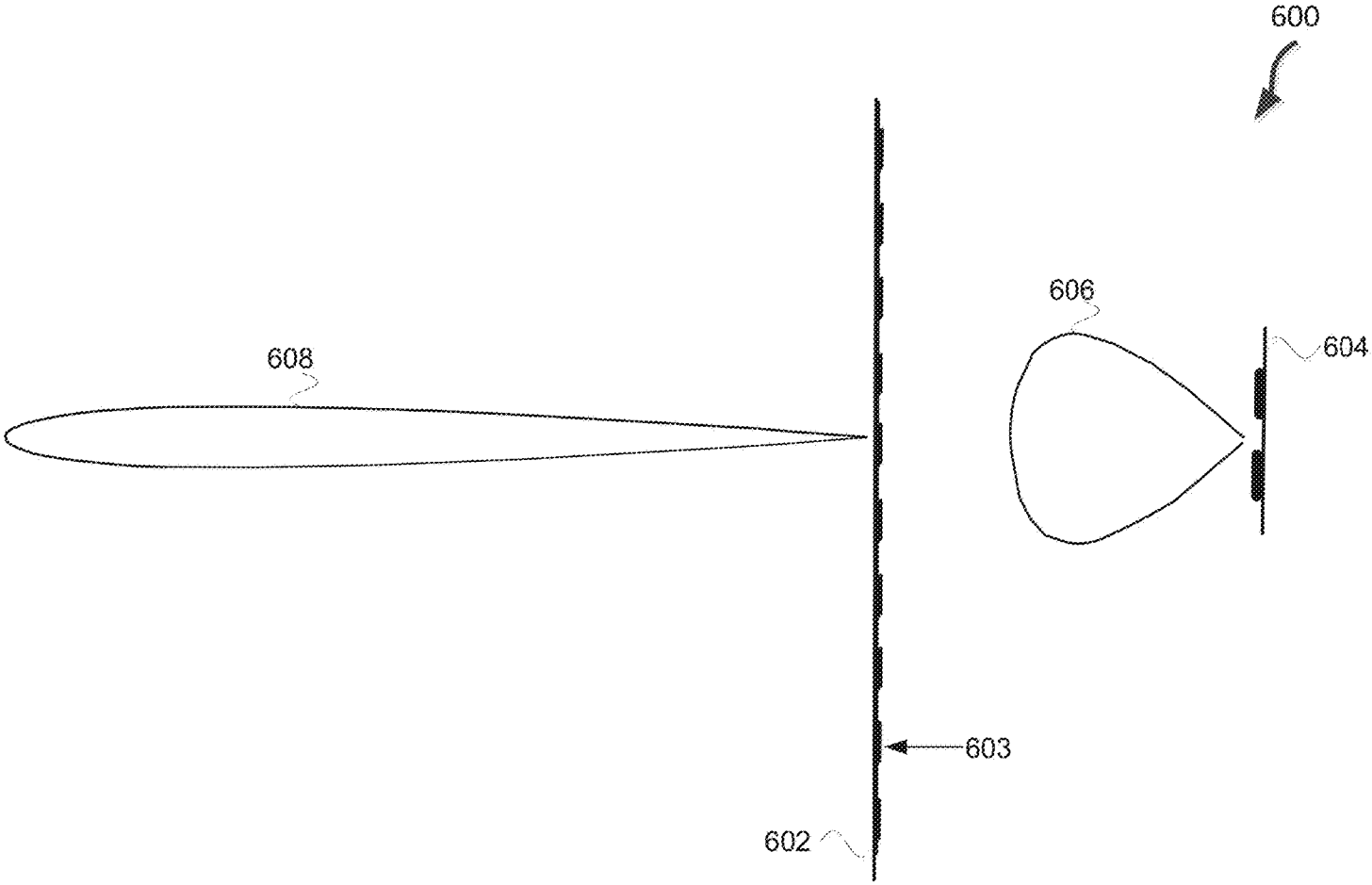
FIG. 6 illustrates a millimeter-wave steerable reflect array-feeding array antenna with transparent phase changing elements in accordance with some embodiments.

FIG. 6 illustrates a millimeter-wave steerable reflect array-feeding array antenna 600 with transparent phase changing elements in accordance with some embodiments. Illustrated in FIG. 6 is reflect array 602, phased antenna array 604, phased antenna array beam 606, and refracted phased antenna array beam 608.

The reflect array 602 may include transparent elements 603. The reflect array 602 may be configured with transparent elements 603 with phase shifts to act like a Fresnel lens so that phased antenna array beam 606 is narrowed with a higher grain to form refracted phased antenna array beam 608.

Figure 7:
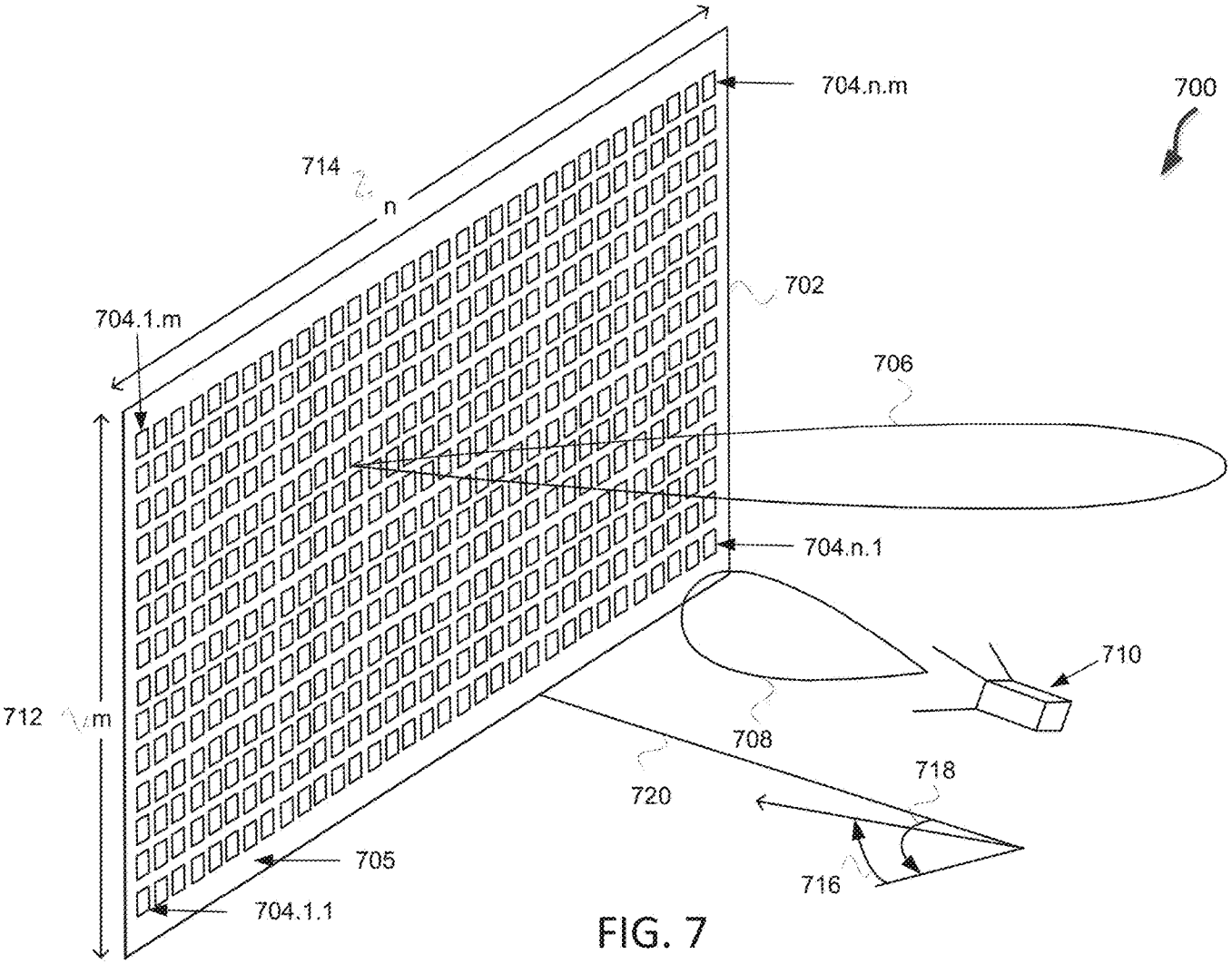
FIG. 7 illustrates a millimeter-wave reflect array-feeding array antenna in a WLAN in accordance with some embodiments.

FIG. 7 illustrates a millimeter-wave reflect array-feeding array antenna 700 in a WLAN in accordance with some embodiments. Illustrated in FIG. 7 is reflect array 702, feed antenna 710, altitude 716, azimuth 718, normal line 720, antenna beam 708, and reflected antenna beam 706.

The reflect array 702 includes reflective elements 704 and substrate 705. There may be n 714 by m 712 reflecting elements 704. The corners of the reflect array 702 may be 704.1.1, **704.*n*.1, 704.1.*m*, and 704.*n.m*. The reflective elements 704 may be arranged in a pattern such as a rectangular pattern (as illustrated), a square pattern, or another suitable pattern. In some embodiments, the reflective elements 704 may have a crossed dipole structure that reflects both s-polarized and p-polarized EM waves simultaneously. The reflective elements 704 phase distribution allows focusing the antenna beam 708 to form a focused narrow, e.g., reflected antenna beam 706**.

The reflect array 702 may be an array of reflecting elements 704 printed on a substrate 705. The reflecting elements 704 are configured to provide pre-adjusted phasing to form a focused beam (e.g., reflected antenna beam 706). In operation, the feed antenna 710 emits antenna beam 708 which reflects off the reflect array 702 in accordance with a pre-adjusted phasing to form reflected antenna beam 706.

Figure 8:
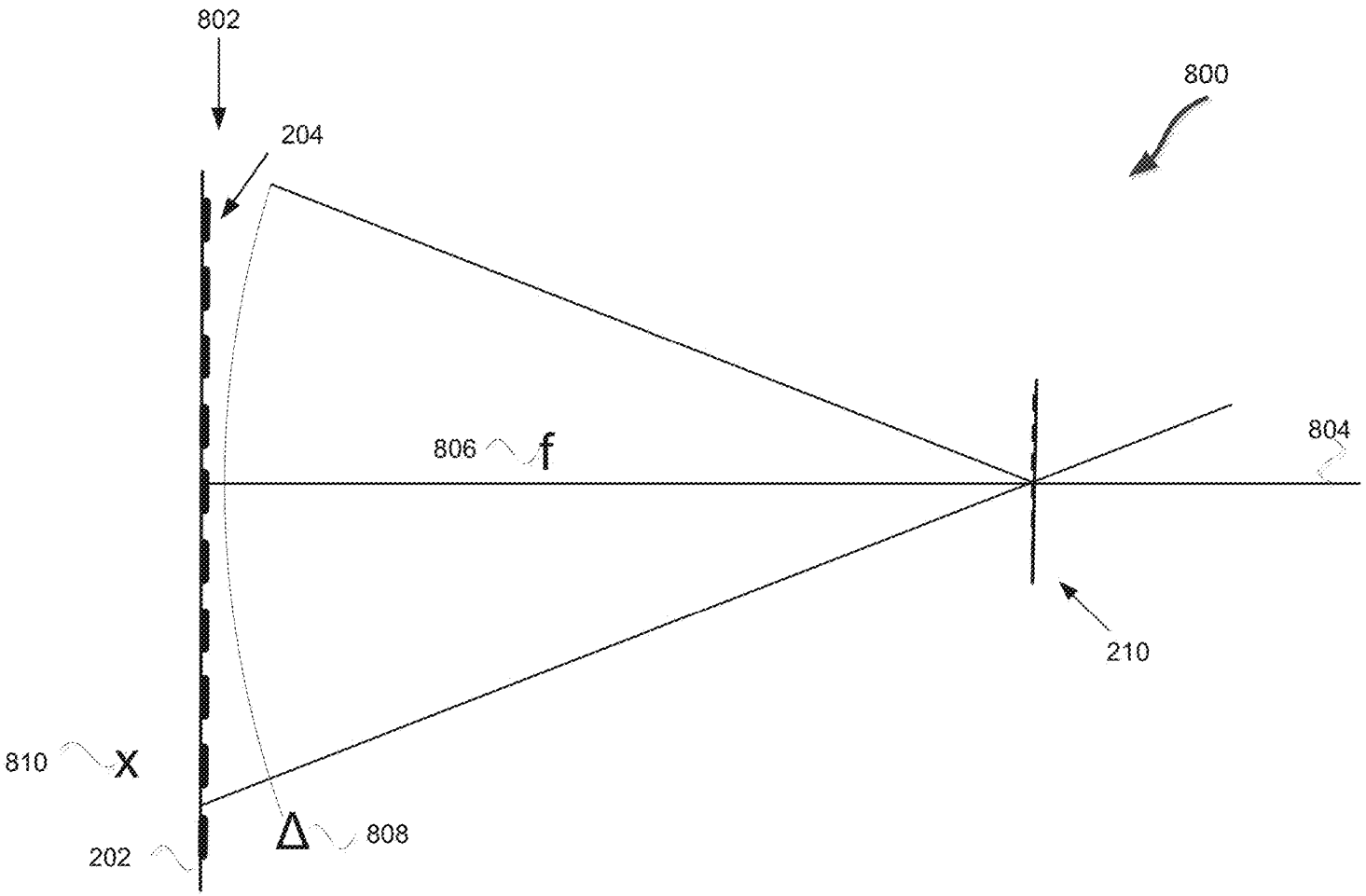
FIG. 8 illustrates a method for determining the phase shifts for reflecting elements in accordance with some embodiments.

FIG. 8 illustrates a method for determining the phase shifts for reflecting elements in accordance with some embodiments. Illustrated in FIG. 8 is reflect array 202, reflecting elements 204, phased antenna array 210, normal line 804, reflecting surface 802, focusing distance (f) 806, path difference (Δ) 808, and the vertical shift X 810, The phased antenna array 210 is located at or near the focus of the reflecting surface 802. The reflecting surface 802 may have properties of a focusing mirror.

The optical paths from the focus point (where phased antenna array 210 is located) to every point at the reflecting surface 802 may be equal or nearly equal for focusing properties of the reflect array 202. The path difference (Δ) 808 may be compensated with a phase shift (φ) of the reflecting surface 802. Equation (1): $=-(2\pi/\lambda)\Delta$, where λ is the wavelength. Equation (1) represents that the phase change due to propagation of an additional distance Δ is equal to $(2\pi/\lambda)\Delta$ radians.

Equation (2): $\Delta=\sqrt{x^2+f^2}-f$. Substituting Equation (2) into Equation (1) yields Equation (3): $\varphi(x)=-(2\pi/\lambda)(\sqrt{x^2+f^2}-f)$. Equation (3) can then be used for determining the phase shifts for the reflecting elements 204 for a given vertical shift X 810.

The phase shifts at a reflecting element 204 of the reflect array 202 are configured to achieve the desired wavefront transformation. In some embodiments, transforming a diverging beam (e.g., phased antenna array beam 208 of FIG. 2) from the phased antenna array 210 to the directional reflected phased antenna array beam 206 after reflection. In some embodiments the phase shifts distribution may resemble a spherical or a parabolic mirror, transforming a radial wavefront into a flat (either vertical or horizontal) wave front.

Figure 9:
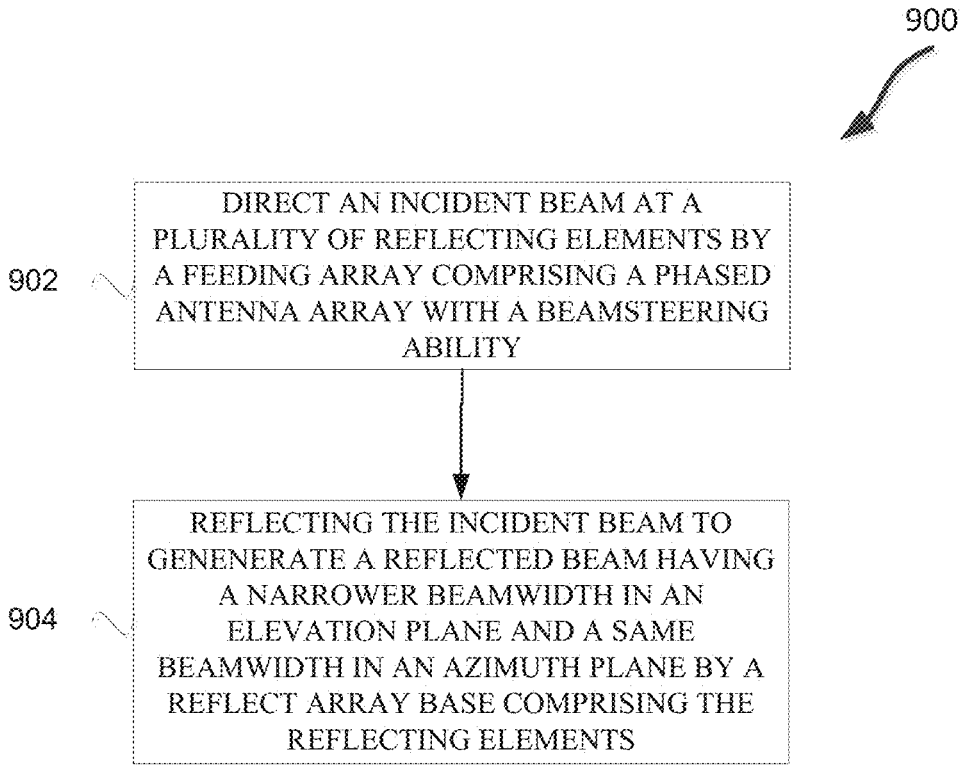
FIG. 9 illustrates a method performed by a millimeter-wave high-gain steerable reflect array-feeding array antenna in a wireless local area network in accordance with some embodiments.

FIG. 9 illustrates a method 900 performed by a millimeter-wave high-gain steerable reflect array-feeding array antenna in a wireless local area network in accordance with some embodiments. The method 900 may begin at operation 902 with directing an incident beam at a plurality of reflecting elements by a feeding array comprising a phased antenna array with a beamsteering ability.

For example, phased antenna array 210 directs phased antenna array beam 208 (FIG. 2) at reflect array 202. For example, phased antenna array 210 directs phased antenna array beam 302 (FIG. 3) at reflect array 202. For example, phased antenna array 210 directs phased antenna array beam 402 (FIG. 4) at reflect array 202.

The method 900 continues at operation 904 with reflecting the incident beam to generate a reflected beam having a narrower beamwidth in an elevation plane and a same beamwidth in an azimuth plane by a reflect array base comprising the reflecting elements. For example, reflect array 202 reflects reflected phased antenna array beam 206 (FIG. 2) so that the reflected beam is narrower in an elevation plane and is a same width in an azimuth plane. For example, reflect array 202 reflects reflected phased antenna array beam 306 (FIG. 3) so that the reflected beam is narrower in an elevation plane and is a same width in an azimuth plane. For example, reflect array 202 reflects reflected phased antenna array beam 406 (FIG. 4) so that the reflected beam is narrower in an elevation plane and is a same width in an azimuth plane.

Figure 10:
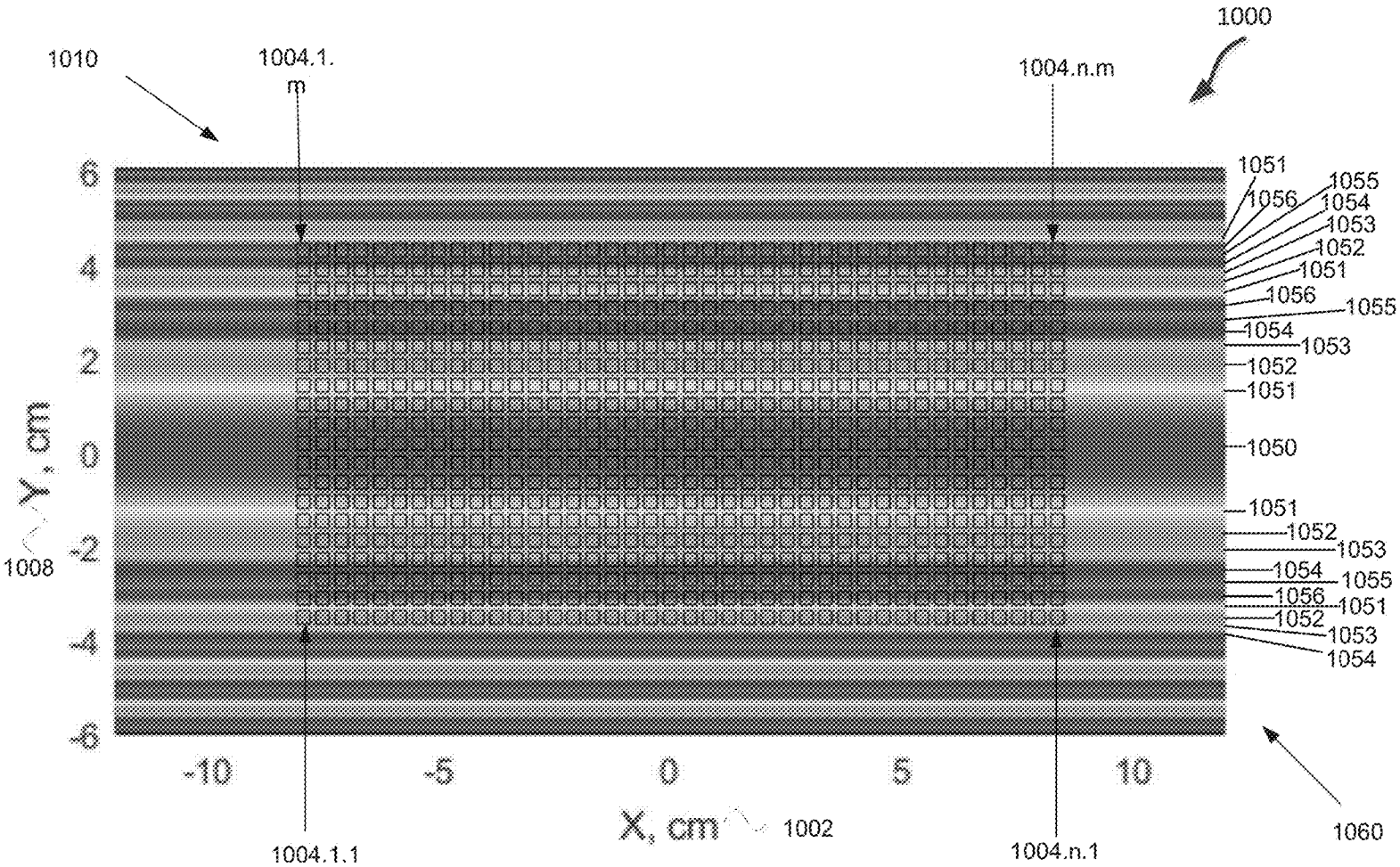
FIG. 10 illustrates the phase shift in radians for reflecting elements of the reflect array of FIGS. 2-4 in accordance with some embodiments.

FIG. 10 illustrates the phase shift in radians 1000 for reflecting elements 1002 of the reflect array of FIGS. 2-4 in accordance with some embodiments. Illustrated in FIG. 10 is reflect array 1010 with reflecting elements 1004. Illustrated along the horizontal axis is the x 1002 coordinate in centimeters (cm) of the reflect array 1010. Illustrated along the vertical axis is the y 1008 coordinate in cm of the reflect array 1010. There may be n by m reflecting elements 1004. The corners of the reflect array 1010 may be 1004.1.1, **1004.*n*.1, 1004.1.*m*, and 1004.*n.m*. The reflective elements 1004** may be arranged in a pattern such as a rectangular pattern as illustrated), a square pattern, or another suitable pattern.

A phase pattern 1060 of the reflecting elements 1004 is indicated in radians with 1050 being zero radian phase shift, 1051 being one radian phase shift, 1052 being two radian phase shift, 1053 being three radian phase shift, 1054 being four radian phase shift, 1055 being five radian phase shift, and 1056 being six radian phase shift. The phase shifts 1060 changes are along columns of reflecting elements 1004. The phase shifts 1060 remain similar or unchanged along rows of reflecting elements 1004. In some embodiments, the phase shifts 1060 along rows may be similar to within a threshold. In some embodiments, the threshold may be small no as not to affect the phase shift of the incoming beam. The phase shift of reflecting elements 1004.1.1 and **1004.*n*.1 may be 1052 or two radians. The phase shift of reflecting elements 1004.1.*m* and 1004.*n.m* may be 1056 or six radians and 1055 or five radians. The phase shift may depend on the portion of the reflecting elements 1004. FIG. 8 illustrates how the phase shift for each reflecting element 1104 may be determined. The code of Table 1 can be derived from FIG. 8** and the accompanying text.

Figure 11:
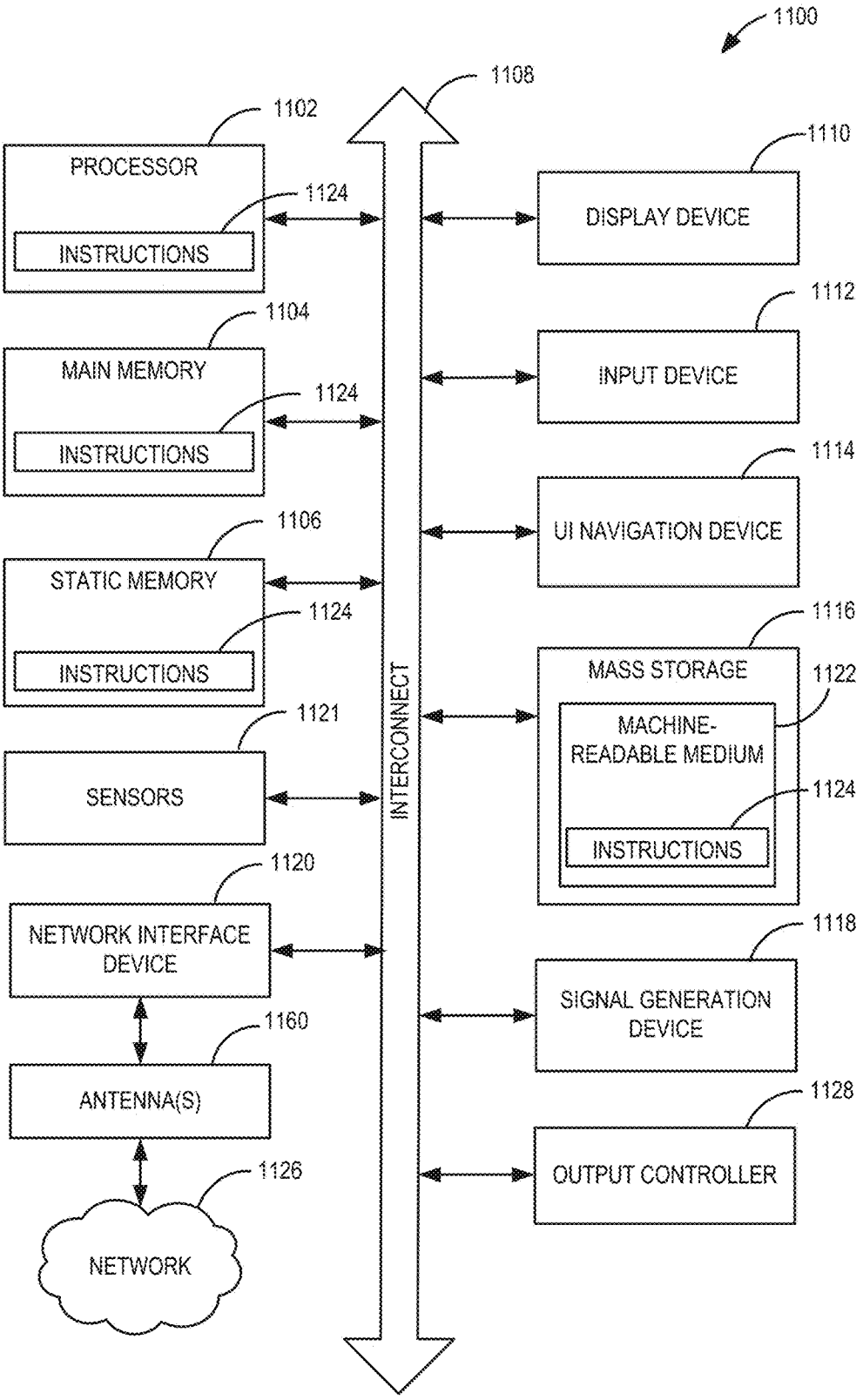
FIG. 11 illustrates a block diagram of an example machine upon which any one or more of the techniques (e.g., methodologies) discussed herein may perform.

Table 1 illustrates MatLab® code to generate FIG. 11. The phase shifts may be adjusted to change the narrowing of the incident beam in the elevation plane. In table 1 if the commented line of code that begins with % is included, then a phase distribution for reflecting elements would be generated for a focused narrow beam (not illustrated).

TABLE 1

MATLAB CODE TO GENERATE FIG. 11

```
f = 10; % cm
lambda = 0.5; % cm
xmax = 6;
step = .05;
xrange1 = −xmax:step:xmax;
xrange2 = −2*xmax:step:2*xmax;
Z = zeros(nume1(xrange1),nume1(xrange2)) ;
for i1 = 1:nume1(xrange1),
    for i2 = 1:nume1(xranqe2) ,
        % r = sqrt(xrange1(i1) .^2+xrange2 (i2) .^2) ;
        r = xrange1(i1) ;
        d = f−sqrt(f.^2+r.^2) ;
        phi = −2*pi*d/lambda;
        Z (i1,i2) = mod(phi, 2*pi) ;
  end
end
pcolor(xrange2, xrange1, Z) ; shading flat
colormap hsv
axis equal
xlabel ('X, cm')
ylabel ('Y, cm')
title ('Phase shift, radians' )
```

FIG. 11 illustrates a block diagram of an example machine 1100 upon which any one or more of the techniques (e.g., methodologies) discussed herein may perform. In alternative embodiments, the machine 1100 may operate as a standalone device or may be connected (e.g., networked) to other machines. In a networked deployment, the machine 1100 may operate in the capacity of a server machine, a client machine, or both in server-client network environments. In an example, the machine 1100 may act as a peer machine in peer-to-peer (P2P) (or other distributed) network environment. The machine 1100 may be a master station 102, HE station 104, personal computer (PC), a tablet PC, a set-top box (STB), a personal digital assistant (PDA), a mobile telephone, a smart phone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate on, logic or a number of components, modules, or mechanisms. Modules are tangible entities e.g., hardware) capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine readable medium. In an example, the software, when executed by the underlying hardware of the module, causes the hardware to perform the specified operations.

Accordingly, the term "module" is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

Machine (e.g., computer system) 1100 may include a hardware processor 1102 (e.g., a central processing unit (CPU), a graphics processing unit (GPU), a hardware processor core, or any combination thereof), a main memory 1104 and a static memory 1106, some or all of which may communicate with each other via an interlink (e.g., bus) 1108. The machine 1100 may further include a display device 1110, an input device 1112 (e.g., a keyboard), and a user interface (UI) navigation device 1114 (e.g., a mouse). In an example, the display device 1110, input device 1112 and UI navigation device 1114 may be a touch screen display. The machine 1100 may additionally include a mass storage (e.g., drive unit) 1116, a signal generation device 1118 (e.g., a speaker), a network interface device 1120, and one or more sensors 1121, such as a global positioning system (GPS) sensor, compass, accelerometer, or other sensor. The machine 1100 may include an output controller 1128, such as a serial (e.g., universal serial bus (USB), parallel, or other wired or wireless e.g., infrared (IR), near field communication (NFC), etc.) connection to communicate or control one or more peripheral devices (e.g., a printer, card reader, etc.).

In some embodiments the processor 1102 and/or instructions 1124 may comprise processing circuitry and/or transceiver circuitry.

The storage device 1116 may include a machine readable medium 1122 on which is stored one or more sets of data structures or instructions 1124 (e.g., software embodying or utilized by any one or more of the techniques or functions described herein. The instructions 1124 may also reside, completely or at least partially, within the main memory 1104, within static memory 1106, or within the hardware processor 1102 during execution thereof by the machine 1100. In an example, one or any combination of the hardware processor 1102, the main memory 1104, the static memory 1106, or the storage device 1116 may constitute machine readable media.

While the machine readable medium 1122 is illustrated as a single medium, the term "machine readable medium" may include a single medium or multiple media (e.g., a centralized or distributed database, and/or associated caches and servers) configured to store the one or more instructions 1124.

The term "machine readable medium" may include any medium that is capable of storing, encoding, or carrying instructions for execution by the machine 1100 and that cause the machine 1100 to perform any one or more of the techniques of the present disclosure, or that is capable of storing, encoding or carrying data structures used by or associated with such instructions. Non-limiting machine readable medium examples may include solid-state memories, and optical and magnetic media. Specific examples of machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; Random Access Memory (RAM); and CD-ROM and DVD-ROM disks. In some examples, machine readable media may include non-transitory machine readable media. In some examples, machine readable media may include machine readable media that is not a transitory propagating signal.

The instructions 1124 may further be transmitted or received over a communications network 1126 using a transmission medium via the network interface device 1120 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, a Long Term Evolution (LTE) family of standards, a Universal Mobile Telecommunications System (UMTS) family of standards, peer-to-peer (P2P) networks, among others.

In an example, the network interface device 1120 may include one or more physical jacks (e.g., Ethernet, coaxial, or phone jacks or one or more antennas to connect to the communications network 1126. In an example, the network interface device 1120 may include one or more antennas 1160 to wirelessly communicate using at least one of single-input multiple-output (SIMO), multiple-input multiple-output (MIMO), or multiple-input single-output (MISO) techniques. In some embodiments, the antennas 1160 may be a reflect array as described in conjunction with one or more of FIGS. 1-10. In some examples, the network interface device 1120 may wirelessly communicate using Multiple User MIMO techniques. The term "transmission medium" shall be taken to include any intangible medium that is capable of storing, encoding or carrying instructions for execution by the machine 1100, and includes digital or analog communications signals or other intangible medium to facilitate communication of such software.

Various embodiments of the invention may be implemented fully or partially in software and/or firmware. This software and/or firmware may take the form of instructions contained in or on a non-transitory computer-readable storage medium. Those instructions may then be read and executed by one or more processors to enable performance of the operations described herein. The instructions may be in any suitable form, such as but not limited to source code, compiled code, interpreted code, executable code; static code, dynamic code, and the like. Such a computer-readable medium may include any tangible non-transitory medium for storing information in a form readable by one or more computers, such as but not limited to read only memory (ROM); random access memory (RAM); magnetic disk storage media; optical storage media; flash memory, etc.

The following examples pertain to further embodiments. Specifics in the examples may be used in one or more embodiments.

Example 1 is a reflect array-feeding array (RA-FA) antenna, the RA-FA antenna including: a reflect array base including a plurality of reflecting elements with a phase shift distribution to reflect an incident beam to generate a reflected beam having a narrower beamwidth in an elevation plane and a same beamwidth in an azimuth plane, and a feeding array including a phased antenna array with a beam-steering ability to direct the incident beam at the reflecting elements.

In Example 2, the subject matter of Example 1 can optionally include where each reflecting element of the plurality of reflecting elements is configured to produce a path difference of the incident beam to generate a reflected beam having a narrower beamwidth in the elevation plane, where an elevation displacement (x) of the reflecting element from a focal point of the RA-FA determines a phase shift the reflecting element is configured to produce in the path difference of the incident beam.

In Example 3, the subject matter of Example 2 can optionally include where the phase shift the reflecting element is configured to produce to the incident beam is determined as follows: $\varphi(x)=-(2\pi/\lambda)(\sqrt{(x^2+f^2)}-f)$, where $\varphi(x)$ is the phase shift for the reflecting element with the elevation displacement of x, $\lambda$ is the wave length of the incident beam, and f is a focal length of the RA-FA antenna In Example 4, the subject matter of any of Examples 1-3 can optionally include where the phase shift distribution of the reflecting elements is configured to reflect the incident beam to generate a reflected beam having a same angle from a normal as the incident beam for the azimuth plane.

In Example 5, the subject matter of any of Examples 1-4 can optionally include where the reflect array base is a flat form and is a rectangular or a square shape.

In Example 6, the subject matter of any of Examples 1-5 can optionally include where the feeding array is configured to emit the incident beam at a range of angles to the reflect array base, where the range of angles is at least −60 degrees through 60 degrees in the azimuth plane, and where the plurality of reflecting elements with the phase shift distribution are configured to reflect the incident beam for the range of angles to generate the reflected beam with a same angle of reflection as an angle of incidence.

In Example 7, the subject matter of any of Examples 1-6 can optionally include where an azimuth beam width of the incident beam is a same azimuth beam width of the reflected beam.

In Example 8, the subject matter of any of Examples 1-7 can optionally include where the reflecting elements have a crossed dipole structure to reflect both s-polarized and p-polarized electromagnetic waves simultaneously.

In Example 9, the subject matter of any of Examples 1-8 can optionally include where the reflecting elements are configured in a pattern with rows and columns and reflecting elements along rows are configured to reflect the incident beam with a same phase shift, and reflecting elements along columns are configured to reflect the incident beam with a phase shift to generate the reflected beam narrower in the elevation plane than the incident beam.

In Example 10, the subject matter of any of Examples 1-9 can optionally include a second reflector array including a second plurality of reflecting elements with a second phase shift distribution to reflect the incident beam to generate a second reflected beam having a wider beamwidth in the elevation plane and a same width in an azimuth plane, and where the feeding array further comprises a switch to switch between directing beams to the reflect array and the second reflect array.

In Example 11, the subject matter of any of Examples 1-10 can optionally include where the reflecting elements are transparent and where the plurality of reflecting elements refract the incident beam as in a Fresnel lens to generate a refracted beam having a narrower beamwidth in the elevation plane.

In Example 12, the subject matter of any of Examples 1-11 can optionally include where the RA-FA antenna is configured to operate in the millimeter-wave bandwidth.

In Example 13, the subject matter of any of Examples 1-12 can optionally include where the RA-FA antenna is configured to operate in accordance with Institute of Electrical and Electronic Engineers (IEEE) 802.11ay.

In Example 14, the subject matter of any of Examples 1-13 can optionally include where the RA-FA antenna is part of one of the following group: an Institute of Electrical and Electronic Engineers (IEEE) 802.11ay access point, an IEEE 802.11 access point, an access point, an IEEE 802.11ay station, an IEEE 802.11ad station, an IEEE 802.11ad access point, and a backhaul replay.

In Example 15, the subject matter of any of Examples 1-14 can optionally include where where the feeding element is positioned at a focal point of the reflect array.

Example 16 is a method performed by a reflect array-feeding array (RA-FA) antenna, the method including: directing an incident beam at a plurality of reflecting elements by a feeding array including a phased antenna array with a beamsteering ability, and reflecting the incident beam to generate a reflected beam having a narrower beamwidth in an elevation plane and a same beamwidth in an azimuth plane by a reflect array base including the reflecting elements In Example 17, the subject matter of Example 16 can optionally include reflecting elements of the plurality of elements in a same row reflecting the incident beam to generate the reflected beam with a same phase shift, and reflecting elements of the plurality of elements in a same column reflecting the incident beam to generate the incident beam having a narrower beamwidth in the elevation plane.

In Example 18, the subject matter of any of Examples 16-17 can optionally include reflecting the incident beam having an angle of incidence from a normal for the azimuth plane to generate the reflected beam having a same angle from the normal for the azimuth plane.

In Example 19, the subject matter of any of Examples 16-18 can optionally include where an elevation beamwidth of the reflected beam is narrower than an elevation beamwidth of the incident beam by at least one half.

In Example 20, the subject matter of any of Examples 15-19 can optionally include where the feeding element is positioned at a focal point of the reflect array.

Example 21 is a reflect array-feeding array (RA-FA) antenna; the RA-FA antenna including: means for directing an incident beam at a plurality of reflecting elements by a feeding array including a phased antenna array with a beamsteering ability, and means for reflecting the incident beam to generate a reflected beam having a narrower beamwidth in an elevation plane and a same beamwidth in an azimuth plane by a reflect array base including the reflecting elements.

In Example 22, the subject matter of Example 21 can optionally include means for reflecting elements of the plurality of elements in a same row reflecting the incident beam to generate the reflected beam with a same phase shift; and means for reflecting elements of the plurality of elements in a same column reflecting the incident beam to generate the incident beam having a narrower beamwidth in the elevation plane.

In Example 23, the subject matter of Examples 21 or 22 can optionally include means for reflecting the incident beam having an angle of incidence from a normal for the azimuth plane to generate the reflected beam having a same angle from the normal for the azimuth plane.

In Example 24, the subject matter of any of Examples 21-23 can optionally include means for reflecting the incident beam so that an azimuth beam width of the incident beam is a same azimuth beam width of the reflected beam.

In Example 25, the subject matter of any of Examples 21-24 can optionally include means for reflecting both s-polarized and p-polarized electromagnetic waves simultaneously.

In Example 26, the subject matter of any of Examples 21-25 can optionally include means for reflecting the incident beam along rows with a same phase shift, and means for reflecting along columns with phase shifts to narrow the incident beam to form the reflected beam narrower in the elevation plane.

In Example 27, the subject matter of any of Examples 21-26 can optionally include means for a second reflector array including a second plurality of reflecting elements with a second phase shift distribution; means for reflecting the incident beam to generate a second reflected beam having a wider beamwidth in the elevation plane and a same width in an azimuth plane; and means for the feeding array to switch between directing beams to the reflect array and the second reflect array.

In Example 28, the subject matter of any of Examples 21-2.7 can optionally include means for the plurality of reflecting elements to refract the incident beam as in a Fresnel lens to generate a refracted beam having a narrower beamwidth in the elevation plane.

In Example 29, the subject matter of any of Examples 21-28 can optionally include means for operating in the millimeter-wave bandwidth.

In Example 30, the subject matter of any of Examples 21-29 can optionally include means for operating in accordance with Institute of Electrical and Electronic Engineers (IEEE) 802.11ay.

In Example 31, the subject matter of any of Examples 21-30 can optionally include means for directing the incident beam at a range of angels from at least −60 degrees through 60 degrees and at a focal point of the reflect array.

In Example 31, the subject matter of any of Examples 21-31 can optionally include means for each reflecting element of the plurality of reflecting elements producing a path difference of the incident beam to generate a reflected beam having a narrower beamwidth in the elevation plane, where an elevation displacement (x) of the reflecting element from a focal point of the RA-FA determines a phase shift the reflecting element is configured to produce in the path difference of the incident beam.

In Example 33, the subject matter of Example 32 can optionally include where the phase shift the reflecting element produces to the incident beam is determined as follows: $\varphi(x)=-(2\pi/\lambda)(\sqrt{(x^2+f^2)}-f)$, where $\varphi(x)$ is the phase shift for the reflecting element with the elevation displacement of x, $\lambda$ is the wave length of the incident beam, and f is a focal length of the RA-FA antenna.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A reflect array-feeding array (RA-FA) antenna, the RA-FA antenna comprising:

a reflect array base comprising a plurality of reflecting elements with a phase shift distribution to reflect an incident beam to generate a reflected beam having a narrower beamwidth in an elevation plane and a same beamwidth in an azimuth plane; and a feeding array comprising a phased antenna array with a beam-steering ability to direct the incident beam at the reflecting elements, wherein each reflecting element of the plurality of reflecting elements is configured to produce a path difference of the incident beam to generate a reflected beam having a narrower beamwidth in the elevation plane, wherein an elevation displacement (x) of the reflecting element from a focal point of the RA-FA determines a phase shift the reflecting element is configured to produce in the path difference of the incident beam.

2. The RA-FA antenna of claim 1, wherein the phase shift the reflecting element is configured to produce relative to the incident beam is determined as follows: $\varphi(x)=-(2\pi/\lambda)(\sqrt{x^2+f^2}-f)$, where $\varphi(x)$ is the phase shift for the reflecting element with the elevation displacement of x, $\lambda$ is the wave length of the incident beam, and f is a focal length of the RA-FA antenna.

3. The RA-FA antenna of claim 1, wherein the phase shift distribution of the reflecting elements is configured to reflect the incident beam to generate a reflected beam having a same angle from a normal as the incident beam for the azimuth plane.

4. The RA-FA antenna of claim 1, wherein the reflect array base is a flat form and is a rectangular or a square shape.

5. The RA-FA antenna of claim 1, wherein the feeding array is configured to emit the incident beam at a range of angles to the reflect array base, wherein the range of angles is at least−60 degrees through 60 degrees in the azimuth plane, and wherein the plurality of reflecting elements with the phase shift distribution are configured to reflect the incident beam for the range of angles to generate the reflected beam with a same angle of reflection as an angle of incidence.

6. The RA-FA antenna of claim 1, wherein an azimuth beam width of the incident beam is a same azimuth beam width of the reflected beam.

7. The RA-FA antenna of claim 1, wherein the reflecting elements have a crossed dipole structure to reflect both s-polarized and p-polarized electromagnetic waves simultaneously.

8. The RA-FA antenna of claim 1, wherein the reflecting elements are configured in a pattern with rows and columns and reflecting elements along rows are configured to reflect the incident beam with a same phase shift, and reflecting elements along columns are configured to reflect the incident beam with a phase shift to generate the reflected beam narrower in the elevation plane than the incident beam.

9. The RA-FA antenna of claim 1, further comprising: a second reflector array comprising a second plurality of reflecting elements with a second phase shift distribution to reflect the incident beam to generate a second reflected beam having a wider beamwidth in the elevation plane and a same width in an azimuth plane, and wherein the feeding array further comprises a switch to switch between directing beams to the reflect array and the second reflect array.

10. The RA-FA antenna of claim 1, wherein the plurality reflecting elements are transparent and wherein the plurality of reflecting elements refract the incident beam as in a Fresnel lens to generate a refracted beam having a narrower beamwidth in the elevation plane.

11. The RA-FA antenna of claim 1, wherein the RA-FA antenna is configured to operate in the millimeter-wave bandwidth.

12. The RA-FA antenna of claim 1, wherein the RA-FA antenna is configured to operate in accordance with Institute of Electrical and Electronic Engineers (IEEE) 802.11ay.

13. The RA-FA antenna of claim 1, wherein the RA-FA antenna is part of one of the following group: an Institute of Electrical and Electronic Engineers (IEEE) 802.11 ay access point, an IEEE 802.11 access point, an access point, an IEEE 802.11 ay station, an IEEE 802.11ad station, an IEEE 802.11ad access point, and a backhaul replay.

14. The RA-FA antenna of claim 1, wherein a feeding element is positioned at a focal point of the reflect array.

15. A method performed by a reflect array-feeding array (RA-FA) antenna, the method comprising:

directing an incident beam at a plurality of reflecting elements by a feeding array comprising a phased antenna array with a beamsteering ability;

reflecting the incident beam to genenerate a reflected beam having a narrower beamwidth in an elevation plane and a same beamwidth in an azimuth plane by a reflect array base comprising the reflecting elements;

each reflecting elements of the plurality of elements in a same row reflecting e incident beam to generate the reflected beam with a same phase shift; and each reflecting elements of the plurality of elements in a same column reflecting the incident beam to generate the incident beam having a narrower beamwidth in the elevation plane.

16. The method of claim 15, further comprising:

reflecting the incident beam having an angle of incidence from a normal for the azimuth plane to generate the reflected beam having a same angle from the normal for the azimuth plane.

17. The method of claim 15, wherein an elevation beamwidth of the reflected beam is narrower than an elevation beamwidth of the incident beam by at least one half.

18. The method of claim 15, wherein a feeding element is positioned at a focal point of the reflect array.

* * * * *